United States Patent [19]

Hashimoto et al.

[11] Patent Number: 4,629,348

[45] Date of Patent: Dec. 16, 1986

[54] WRITING INSTRUMENT WITH SEALING CAP AND ADDITIONAL REARWARD SEAL

[75] Inventors: Yasuyuki Hashimoto, Hyogo; Kazuo Shimizu, Osaka, both of Japan

[73] Assignee: Ancos Co., Ltd., Osaka, Japan

[21] Appl. No.: 574,787

[22] Filed: Jan. 27, 1984

[30] Foreign Application Priority Data

| | | | |
|---|---|---|---|
| Jan. 27, 1983 | [JP] | Japan | 58-10507[U] |
| Mar. 8, 1983 | [JP] | Japan | 58-32280[U] |
| Aug. 4, 1983 | [JP] | Japan | 58-141856 |

[51] Int. Cl.[4] ..... B43K 9/00; B43K 7/12

[52] U.S. Cl. ..... 401/107; 401/108

[58] Field of Search ..... 401/107, 108, 109, 100, 401/116

[56] References Cited

U.S. PATENT DOCUMENTS

| | | | |
|---|---|---|---|
| 1,235,096 | 7/1917 | Beckett | 401/107 |
| 1,580,987 | 4/1926 | Alford | 401/108 |
| 2,438,231 | 3/1948 | Schultz et al. | 401/100 |
| 3,292,593 | 12/1966 | Furuya | 401/107 |
| 3,399,946 | 9/1968 | Tokorozawa et al. | 401/108 |
| 3,525,573 | 8/1970 | Fend | 401/108 |
| 3,672,783 | 6/1972 | Bajusz | 401/116 |
| 4,469,462 | 9/1984 | Hashimoto et al. | 401/107 |
| 4,479,732 | 10/1984 | Shimizu | 401/107 |

FOREIGN PATENT DOCUMENTS

| | | | |
|---|---|---|---|
| 1561795 | 4/1970 | Fed. Rep. of Germany | 401/107 |
| 2234136 | 1/1974 | Fed. Rep. of Germany | 401/108 |
| 1419821 | 10/1965 | France | 401/108 |
| 469200 | 2/1952 | Italy | 401/108 |
| 506654 | 12/1954 | Italy | 401/108 |
| 257750 | 4/1949 | Switzerland | 401/108 |
| 464506 | 4/1937 | United Kingdom | 401/107 |
| 1400781 | 7/1975 | United Kingdom | 401/108 |

*Primary Examiner*—Steven A. Bratlie

*Attorney, Agent, or Firm*—Sughrue, Mion, Zinn, Macpeak, and Seas

[57] ABSTRACT

A writing instrument comprises a barrel having a front opening (216), a writing member (217) having a writing tip (220) on a front end thereof and disposed in the barrel for back-and-forth movement therein, a mechanism disposed between said barrel and the writing member (217) for locking the writing member (217) in an advanced position and returning the writing member (217) in a retracted position, a sealing body (206) pivotable about a single point in the vicinity of the opening (216) for opening and closing the writing tip (220), bias spring (213) disposed between the sealing body (206) and the barrel for normally urging the sealing body (206) to seal the writing tip (216), the writing member (217) pushing aside the sealing body (206) to release the writing tip against a force tending to seal the latter, the writing tip (220) being prevented from contacting the sealing body (206) when the writing member (217) advances, and a seal member for providing a seal between the barrel and the writing member (217) at a position behind the sealing body (216).

20 Claims, 36 Drawing Figures

331
333
S2
332
329
327
330
326
328
304
322
301
302
320
319
308
307
S1
321
303
323
324
306
325
309
305
313
310
314

WRITING INSTRUMENT WITH SEALING CAP AND ADDITIONAL REARWARD SEAL

BACKGROUND OF THE INVENTION

The present invention is applicable to a variety of writing instruments such as a fountain pen, a fabric-tip pen, a ball-point pen or the like, but is especially most effective when incorporated in writing instruments such as a fabric-pen and a water-ink ball-point pen.

The applicant has already filed applications on various writing instruments in which a seal cap or a seal ball is movable into and out of a sealing position in response to a knocking or turning motion for sealing a writing tip or unsealing the same in readiness for writing as disclosed by U.S. patent application No. 394,987 filed on July 2, 1982 by the present applicants, now U.S. Pat. No. 4,479,732 and U.S. patent application Ser. No. 394,957 filed on July 2, 1982 by the present applicants, now U.S. Pat. No. 4,469,462. These prior writing instruments have an air vent hole defined in the vicinity of a tip end portion of a cartridge to seal the writing tip near the tip end portion. This structural limitation prevents such prior arrangements from being incorporated in writing members or ink cartridges generally available on the market or those with small modifications. Therefore, the prior inventions have required ink cartridges to be constructed as a whole with special design.

SUMMARY OF THE INVENTION

It is an object of the present invention to provide a writing instrument which can be constructed by utilizing a commercially available writing member or ink cartridge or such an existing writing member with a small modification.

According to the present invention, there is provided a writing instrument comprising a barrel having a front opening, a writing member having a writing tip on a front end thereof and disposed in said barrel for back-and-forth movement therein, a mechanism disposed between said barrel and said writing member for locking said writing member in an advanced position and returning said writing member to a retracted position, a sealing body pivotable about a single point in the vicinity of said opening for opening and closing said writing tip, bias means disposed between said sealing body and said barrel for normally urging said sealing body to seal the writing tip, means for pushing aside said sealing body to release said writing tip against a force tending to seal the latter while preventing said writing tip from contacting said sealing body when said writing member advances, and seal means for providing a seal between said barrel and said writing member at a position behind said sealing body.

According to another aspect of the invention, there is provided a writing instrument comprising a barrel, a writing member housed in said barrel and having a writing tip on a distal end thereof, said writing member being coupled to said barrel, a seal tube fitted over said writing member for back-and-forth movement thereof and having an opening in a distal end thereof for passage therethrough of a tip end of said writing member, a sealing body pivotable about a single point in the vicinity of said opening for opening and closing said opening, and seal means for providing a seal between said seal tube and said writing member at a position behind said sealing body.

According to another embodiment of the invention, there is provided a writing instrument comprising a body composed of a front barrel and a rear barrel which are relatively rotatable, a writing member housed in said body and having a front writing tip, a transmission mechanism disposed between said body and said writing member for moving said writing member back and forth in response to relative rotation of said front and rear barrels, an inner tube mounted in said front barrel and having an opening defined in a distal end thereof, a sealing body positioned adjacent to said opening for opening and closing said opening, bias means for normally urging said sealing body to close said opening, means for pushing aside said sealing body to open said opening against a force tending to close the latter while preventing said writing tip from contacting said sealing body when said writing member advances, and seal means for providing a seal between said body and said writing member at a position behind said sealing body.

DETAILED DESCRIPTION OF THE PREFERRED EMBODIMENTS

The present invention will now be described with reference to the accompanying drawings.

Figure 1:
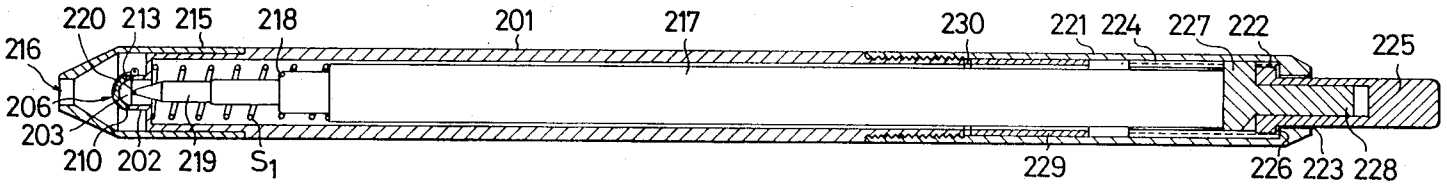
FIGS. 1, 6, 7 and 8 are cross-sectional views of a writing instrument according to an embodiment of the invention, the views showing steps of operation.
Figure 2:
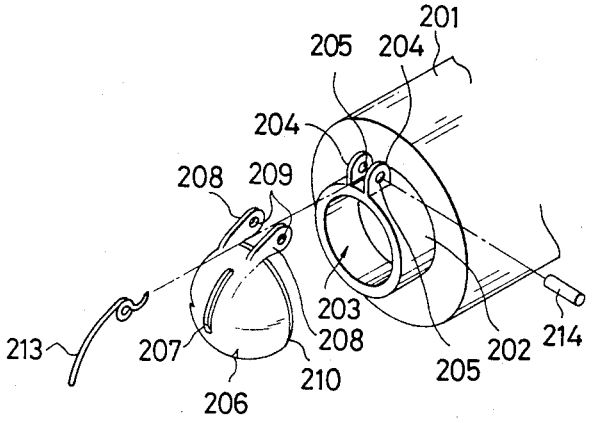
FIG. 2 an exploded perspective partial view of the writing instrument of the first embodiment.
Figure 3:
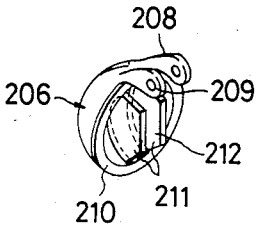
FIG. 3 is a perspective partial view of the writing instrument of the first embodiment.

FIG. 1 is a cross-sectional view illustrative of a writing instrument according to an embodiment of the present invention. The writing instrument comprises a cylindrical front barrel 201 including a smaller-diameter front end portion 202 having a front opening 203. As shown in FIG. 2, the smaller-diameter front end portion 202 has a pair of lugs 204, 204 having small apertures 205, 205, respectively. A substantially disk-shaped sealing body 206 is sized to close the opening 203 in the front barrel 201. The sealing body 206 has a curved front surface with one groove 207 defined therein. The sealing body 206 also has a pair of lugs 208, 208 having respective small apertures 209, 209. As better illustrated in FIG. 3, in which the sealing body 206 is seen from the rear side, a seal ring 210 is attached to a rear peripheral edge of the sealing body 206. The seal ring 210 is dimensioned so as to be equal in shape to a front edge of the smaller-diameter portion 202 of the front barrel 201. The sealing body 206 has on a rear surface thereof substantially disk-shaped projections 211 with a central recess 212 formed therein.

Figure 4:
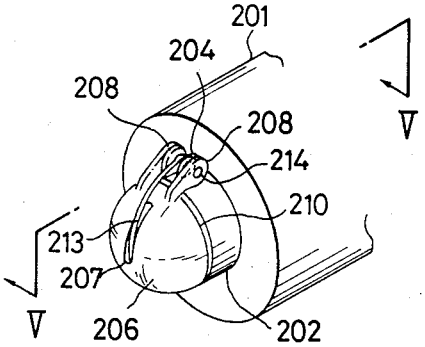
FIG. 4 is a perspective view of the writing instrument of FIG. 2 as assembled.
Figure 5:
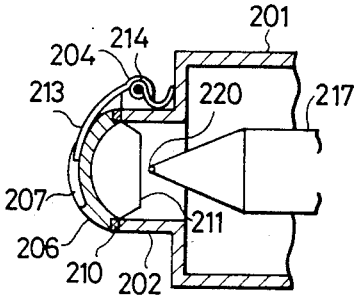
FIG. 5 is a cross-sectional view taken along the line V—V of FIG. 4.

A spring 213 in the form of a single wire has a front portion curved in the shape of a C and a rear coil portion. For assembly, the lugs 204, 204 on the smaller-diameter portion 202 are sandwiched between the lugs 208, 208 on the sealing body 206, and the sealing body 206 is held against the front end of the smaller-diameter portion 202. The C-shape front portion of the spring 213 is fitted into the groove 207 in the sealing body 206 while the coil portion of the spring 213 is positioned between the lugs 204, 204. Thereafter, a pin 214 is inserted through the small apertures 205, 205, 209, 209 in the lugs 204, 204, 208, 208 and the coil portion of the spring 213. The sealing body 206 is thus attached to the front barrel 201 as shown in FIG. 4. As shown in FIG. 5, the sealing body 206 is normally urged by the spring 213 toward the smaller-diameter portion 202 so that the seal ring 210 is held against the front edge of the smaller-diameter portion 202, enabling the sealing body 206 to close and seal the opening 203 in the smaller-diameter portion 202.

A conical front cap 215 having a tapered front end is fitted over a front end portion of the front barrel 201. The front end of the conical front cap 215 has an opening 216. The conical front cap 215 has a space therein for allowing the sealing body 206 mounted on the front end of the front barrel 201 to swing forward.

A spring S1 is disposed in the front barrel 201 at its front end portion, and a writing member 217 such as an ink cartridge is inserted in the spring S1 from a rear end thereof. The spring S1 is interposed between a step formed in the front end of the front barrel 201 and a step formed on an outer periphery of the ink cartridge 217 at a front end portion thereof. The ink cartridge 217 has a front air vent hole 218 and includes a small-diameter front end portion 219 having a writing tip 220 at a distal end thereof.

A rear barrel 221 has a rear end including a radially inward edge which provides a step 222, the rear end having an opening 223 extending behind the step 222. The rear barrel 221 has a cam wall 224 on an inner periphery in a rear end portion thereof. The cam wall 224 has axial grooves and a front inclined locking edge.

A push rod 225 is fitted in the rear barrel 221 and has a larger-diameter front end portion engageable with a step 222 of the rear barrel 221 to prevent the push rod 225 from being pulled rearward out of the rear barrel 221. The larger-diameter front end portion of the push rod 225 has ridges fitted respectively in the axial grooves in the cam wall 224. The front end of the push rod 225 has an inclined edge. The push rod 225 includes a rear end portion projecting rearward through a rear opening 223 in the rear barrel 221. A seal ring 226 is bonded to a rear surface of the larger-diameter front end portion of the push rod 225. A rotary cam 227 is positioned in front of the push rod 225 and has on an outer periphery ridges fitted respectively in the axial grooves in the cam wall 224. The rotary cam 227 has a rear inclined surface and a central rear smaller-diameter portion 228 extending rearward and fitted in the push rod 225.

For assembly, the push rod 225 and then the rotary cam 227 are inserted into the rear barrel 221 from the front end thereof. Thereafter, a cylindrical spacer 229 is fitted in a front end portion of the rear barrel 221, and a seal ring 230 is fitted in the rear barrel 221 in front of the spacer 229. Then, the front end of the rear barrel 221 is threaded over the rear end of the front barrel 201 to interconnect the front and rear barrels 201, 221. The writing instrument is thus assembled as shown in FIG. 1. As assembled, the seal ring 230 is sandwiched under compression between the rear end of the front barrel 201 and the front end of the spacer 229 to provide a seal between the front and rear barrels 201, 221. The ink cartridge 217 is retracted under the force of the spring S1 and fully stored in the front and rear barrels 201, 221. The rotary cam 227 is also pushed back by the ink cartridge 217 along the cam wall 224 of the rear barrel 221. The push rod 225 is also pushed back by the rotary cam 227 along the cam wall 224 and kept in position against further retraction by the seal ring 226 held against the step 222 of the rear barrel 221. At this time, the substantial portion of the push rod 225 projects rearward out of a rear opening 223 in the rear barrel 221.

FIG. 1 shows the ink cartridge 217 in a sealed condition. The opening 203 in the front barrel 201 is sealed by the seal ring 210 pressed against the front end of the smaller-diameter portion 202 by the sealing body 206 under the resiliency of the spring 213. The connected ends of the front and rear barrels 201, 221 are sealed by the seal ring 230. The rear opening 223 in the rear barrel 221 is sealed by the seal ring 226 attached to the push rod 225 and pressed against the step 222 of the rear barrel 221. Therefore, the ink cartridge 217 is completely sealed from the exterior.

Figure 6:
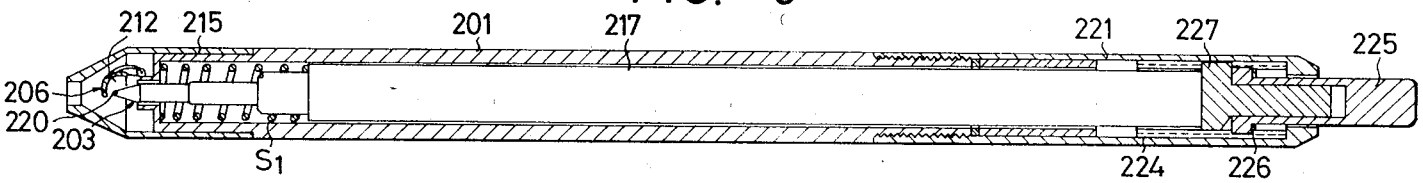
Figure 7:
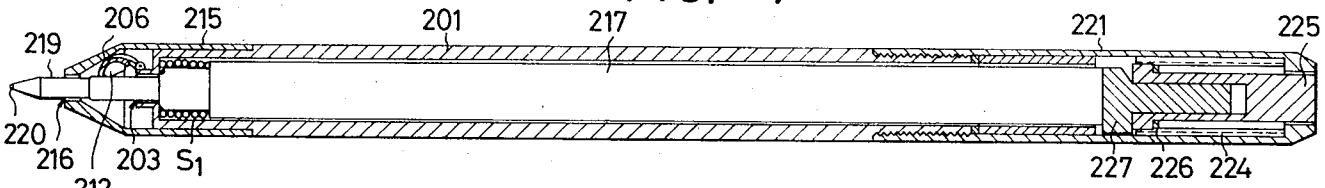

For bringing the writing instrument from the sealed condition into a writing condition, the push rod 225 is pushed. When the push rod 225 is pushed, the ink cartridge 217 is moved forward while compressing the spring S1. As the ink cartridge 217 advances, the writing tip 220 on the front end of the ink cartridge 217 is fitted in the recess 212 in the sealing body 206 and a front inclined surface of the ink cartridge 217 abuts against shoulders of the recess 212. Consequently, the writing tip 220 is prevented from contacting the sealing body 206. As shown in FIG. 6, the writing tip 220 advances while pushing the sealing body 206 aside until the smaller-diameter portion 219 of the ink cartridge 217 projects through the front opening in the conical front cap 215 as illustrated in FIG. 7. At this time, the rotary cam 227 is moved forwardly to a position slightly ahead of the front edge of the cam wall 224 and slightly turned along the front inclined surface of the push rod 225. When the push rod 225 is then released, the ink cartridge 217 and the rotary cam 227 are slightly retracted under the force of the spring S1. However, the rotary cam 227 is engaged by the front edge of the cam wall 224 against further retraction, and the ink cartridge 217 is also prevented by the rotary cam 227 from being moved back. The writing instrument is now in the writing position as shown in FIG. 8 in readiness for writing operation.

Figure 8:
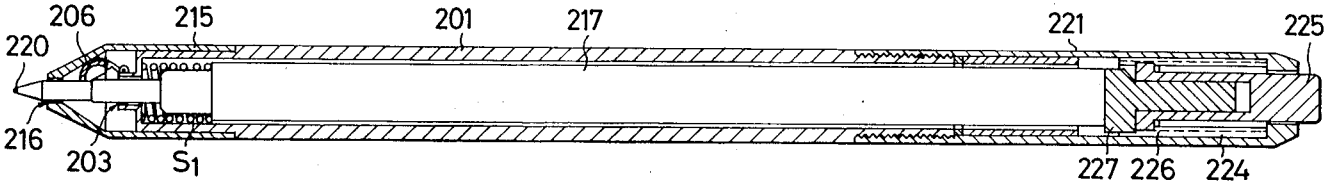

To bring the writing instrument from the writing condition back to the sealed condition, the push rod 225 is pushed in the position shown in FIG. 8. As the push rod 225 is advanced, the rotary cam 227 is also moved forwardly. When the rotary cam 227 is shifted to the position slightly off the front edge of the cam wall 224 as shown in FIG. 7, the push rod 227 is released. Then, the rotary cam 227 is slightly turned and thereafter retracted along the cam wall 224 by the ink cartridge 217 as it is pushed back under the force of the spring S1. The ink cartridge 217 is also retracted until the seal ring 226 attached to the push rod 225 abuts against the step 222 of the rear barrel 221. At this time, the ink cartridge 217 is bodily stored in the front and rear barrels 201, 221, and the opening 203 in the front barrel 201 is closed by the sealing body 206. The writing instrument is now sealed as illustrated in FIG. 1. During movement from the position of FIG. 7 to the position of FIG. 1 via the position of FIG. 6, the ink cartridge 217 is retracted while its front inclined surface is being kept in contact with the shoulders of the recess 212, so that the writing tip 220 is prevented from touching the sealing body 206.

Figure 9:
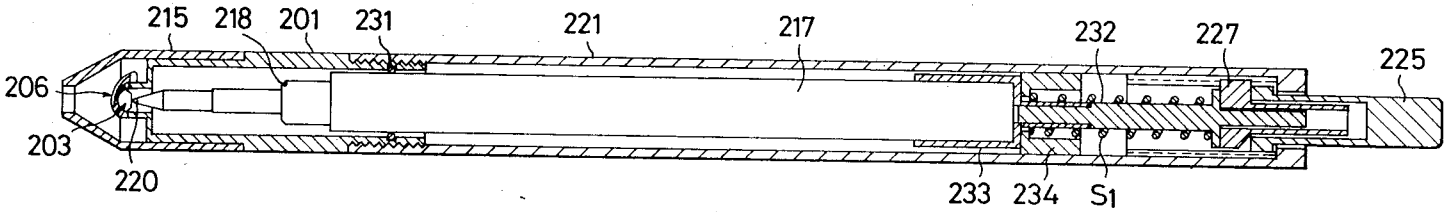
FIGS. 9, 10 and 11 are cross-sectional views of writing instruments according to second, third and fourth embodiments, respectively.

A writing instrument according to another embodiment will be described with reference to FIG. 9. A front barrel 201 is much shorter than that of the first embodiment. A seal ring 231 is retained by an inner periphery near the rear end of the front barrel 201 for providing a seal between the outer periphery of the ink cartridge 217 and the inner periphery of the front barrel 201. Accordingly, the writing tip 220 and the air vent hole 218 are sealed by both the sealing body 206 at the opening 203 in the front barrel 201 and the seal ring 231.

In this embodiment, a spring S1 for normally urging the ink cartridge 217 backward is positioned in a rear portion of a rear barrel 221. A rotary cam 227 has a central hole in which there is fitted a rear end portion of a rod 232 located forward of the rotary cam 227. A connector 233 is composed of a front larger-diameter cylindrical portion and a rear smaller-diameter cylindrical portion. A rear end portion of the ink cartridge 217 is removably fitted in the front larger-diameter cylindrical portion of the connector 233, and the rear smaller-diameter cylindrical portion of the connector 233 is fitted over a front end portion of the rod 232. Thus, the ink cartridge 217 is coupled to the front of the rod 232. A bushing 234 is fitted in the rear end portion of the rear barrel 221. A spring S1 is interposed between the bushing 234 and a radially outward flange of the rod 232 for enabling the rod 232 to bias the ink cartridge 217, the rotary cam 227 and the push rod 225 backwardly.

Figure 10:
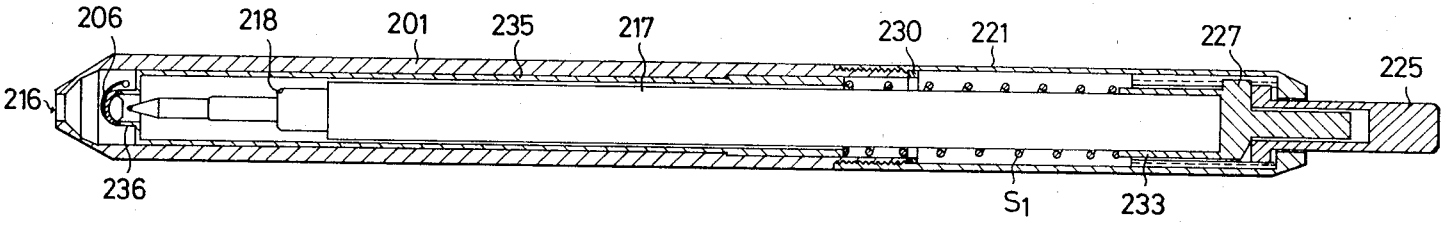

FIG. 10 illustrates a writing instrument according to another embodiment of the present invention. In this embodiment, no conical front cap 215 is employed, but a front barrel 201 has a tapered front end having an opening 216 therein. An inner tube 235 having substantially the same length as the front barrel 201 is inserted into the front barrel 201 from a rear end thereof. The inner tube 235 has a front smaller-diameter portion 236 with a sealing body 206 pivotably mounted thereon at a front end thereof. A cylindrical connector 233 is integral with a front end of a rotary cam 227, and the ink cartridge 217 has a rear end removably fitted in the connector 233. A spring S1 is disposed between a rear end of the inner tube 235 and a front end of the connector 233 for normally biasing the ink cartridge 217 backward. A seal ring 230 is bonded to an inner periphery of a rear barrel 221 near its front end. When the front and rear barrels 201, 221 are interconnected through threaded engagement, the seal ring 230 is held against the rear end of the front barrel 201 to seal the connected portions of the front and rear barrels 201, 221.

Figure 11:
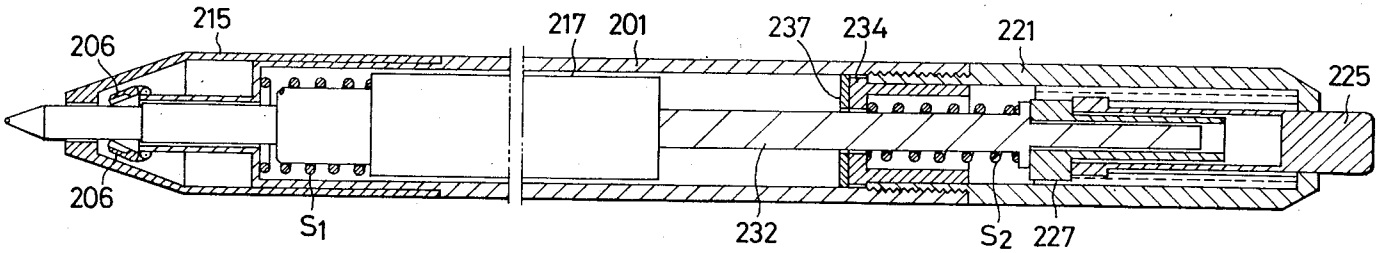
Figure 12:
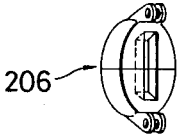
FIG. 12 is a perspective view of the fourth embodiment.

Another embodiment of the present invention will be described with reference to FIGS. 11 and 12. As shown in FIG. 12, a pair of sealing bodies 206, 206 which can swing open away from each other are pivotably mounted on a front end of a front barrel 201. A rod 232 is interposed between an ink cartridge 217 and a rotary cam 227, the rod 232 being not coupled to the ink cartridge 217. A bushing 234 is fitted in a front end portion of a rear barrel 221. A spring S1 for normally urging the ink cartridge 217 rearward is interposed between a step of the front barrel 201 near its front end and a step of the ink cartridge 217 near its front end. A spring S2 for normally biasing the rotary cam 227 and the push rod 225 backward is interposed between a bottom of the bushing 234 and a radially outward flange of the rod 232. A packing 237 is bonded to a front surface of the bushing 234 for providing a rear seal for the ink cartridge 217 and a seal between the connected portions of the front and rear barrels 201, 221.

Figure 14:
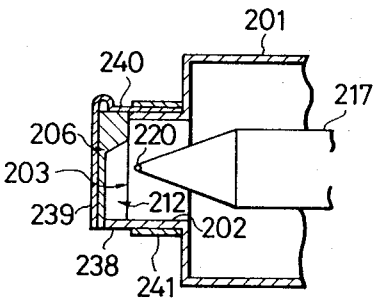
FIG. 14 is a fragmentary cross-sectional view of the fifth embodiment.
Figure 13:
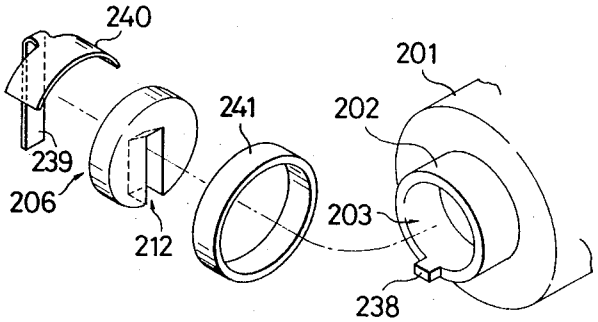
FIG. 13 is an exploded perspective partial view of a fifth embodiment.

Another embodiment of the invention will be described with reference to FIGS. 13 and 14. As shown in FIG. 13, a sealing body 206 has a flat rear surface having a straight recess 212. The front end of the front barrel 201 has a projection 238 sized to neatly fit in the recess 212. A separate leaf spring 239 has a rear arcuate attachment 240. For assembly, as shown in FIG. 14, the leaf spring 239 is bonded to a front surface of the sealing body 206 and the attachment 240 is fitted over the smaller-diameter portion 202 of the front barrel 201. Thereafter, an attachment ring 241 is fitted over the attachment 240 to mount the sealing body 206 so that it closes the opening 203 in the smaller-diameter portion 202. As the sealing body 206 is attached in position, the projection 238 of the smaller-diameter portion 202 is neatly fitted in the recess 212 in the sealing body 206.

Figures 15, 16, 17, 18:
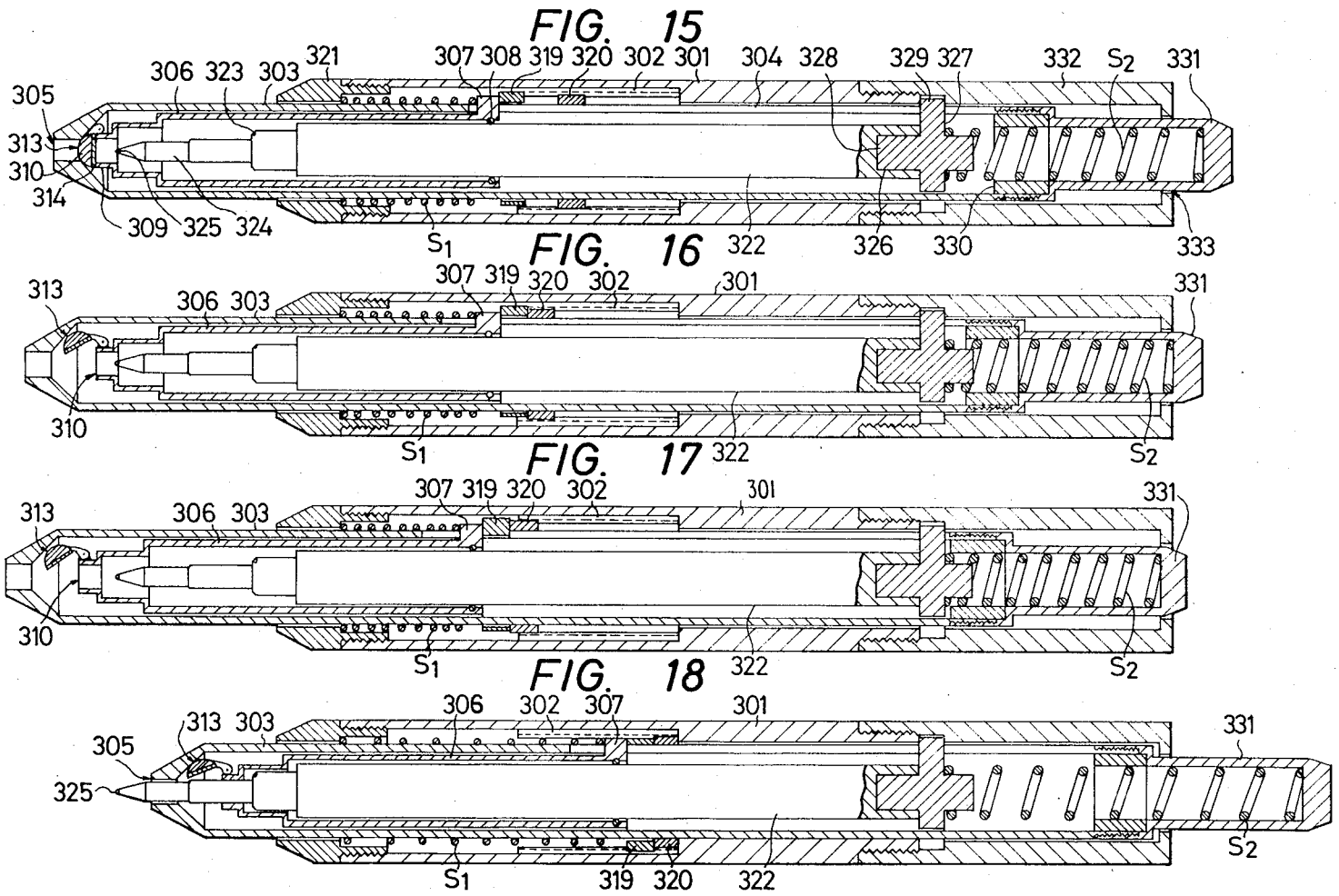
FIGS. 15, 16, 17 and 18 are cross-sectional views showing a sixth embodiment of the invention.

FIG. 15 is a cross-sectional view of a writing instrument according to another embodiment of the present invention. The writing instrument includes a front barrel 301 having axial grooves defined in a cam wall 302 on an inner periphery of the front barrel 301 in the vicinity of a central portion thereof, the cam wall 302 having a front inclined locking edge.

A slidable tube 303 is fitted in the front barrel 301 and has three axial slits 304, 304, 304 extending from a rear end thereof and angularly spaced at equal intervals. The slidable tube 303 has a tapered front end having a through hole 305 in its distal end.

A seal tube 306 is fitted in a front portion of the slidable tube 303. The seal tube 306 has three legs 307, 307, 307 angularly spaced at equal intervals and extending radially outwardly from a rear end of the seal tube 306. The three legs 307, 307, 307 project respectively through the slits 304, 304, 304 in the slidable tube 303 radially outwardly of the slidable tube 303. A seal ring 308 is retained in an inner periphery of the seal tube 306 near a rear end thereof. The seal tube 306 includes a smaller-diameter front end portion 309 having an opening 310 in a distal end thereof.

A sealing body 313 spring biased in its opening direction as described before is attached to the seal tube 306 in the vicinity of the distal end thereof.

A rotary cam 319 is fitted over the slidable tube 303 behind the legs 307, 307, 307 of the seal tube 306. The rotary cam 319 has axial ridges projecting on an outer periphery thereof and fitted respectively in the axial grooves in the cam wall 302. The rotary cam 319 has a rear inclined edge. A cam ring 320 is fixedly fitted over the slidable tube 303 rearward of the rotary cam 319.

The cam ring 320 has ridges projecting on an outer periphery thereof and fitted respectively in the grooves in the cam wall 302. The cam ring 320 also has a front inclined edge. A spring S1 is disposed between the legs 307, 307, 307 of the seal tube 306 and a ring 321 threaded into a front end of the front barrel 301.

A writing member 322 such as an ink cartridge is stored in the seal tube 306 and the slidable tube 303. The ink cartridge 322 can be inserted from a rear end of the front barrel 301. As the ink cartridge 322 is inserted, the seal ring 308 fitted in the seal tube 306 is held in intimate contact with an outer periphery of the ink cartridge 322 to seal the space between the seal tube 306 and the ink cartridge 322. The ink cartridge 322 has a front air vent hole 323 and a smaller-diameter front end portion 324 with a writing tip 325 on its front end. A recess 326 is formed in a rear end of the ink cartridge 322.

A separate connector 327 has a front cylindrical projection 328 fitted in the recess 326 of the ink cartridge 322. The connector 327 has three angularly equidistant legs 329, 329, 329 projecting on an outer periphery thereof and extending radially outwardly through the slits 304, 304, 304 respectively, in the slidable tube 303.

For assembly, a reinforcement ring 330 is fitted in the rear end of the slidable tube 303 and then a spring S2 is disposed between the connector 327 and a bottom of a push member 331, while at the same time a front end portion of the push member 331 is threaded over a rear end portion of the slidable tube 303. Then, the legs 329, 329, 329 of the connector 327 are held against a rear end surface of the front barrel 301, and a rear barrel 332 is fitted over the push member 331 from behind. A front end portion of the rear barrel 332 is threaded over a rear end portion of the front barrel 301. The legs 329, 329, 329 of the connector 327 are now fixedly clamped between the rear end surface of the front barrel 301 and a step formed on an inner periphery of the rear barrel 332 near the front end thereof. The writing instrument is thus assembled as shown in FIG. 15. At this time, the push member 331 is urged by the spring S2 to move backwardly and project rearward through a rear opening 333 in the rear barrel 332.

FIG. 15 shows the writing instrument in a sealed condition. The rotary cam 319 is in an advanced position with the spring S1 under compression and bears the legs 307, 307, 307 of the seal tube 306 to maintain the latter in an advanced position. At this time, the slidable tube 303 is urged backward under the force of the spring S2 to enable an inner surface of the slidable tube 303 at the front end thereof to push the sealing body 313 backwardly. The seal member 314 attached to the sealing body 313 closes and securely seals the opening 310 in the seal tube 306. The seal ring 308 provides a seal between the rear end of the seal tube 306 and the outer periphery of the ink cartridge 322. Accordingly, the air vent hole 323 and the writing tip 325 which are positioned forward of the seal ring 308 are sealed.

To bring the writing instrument from the sealed condition to a writing condition, the push member 331 is pushed, whereupon the slidable tube 303 is advanced while compressing the spring S2. As the slidable tube 303 is moved forwardly, the sealing body 313 is released and swings forward under the resiliency of the spring, thereby opening the opening 310 in the seal tube 306 as shown in FIG. 16. On advancing movement of the slidable tube 303, the cam ring 320 attached to the slidable tube 303 also advances to push the rotary cam 319. The rotary cam 319 pushes the legs 307, 307, 307 to move the seal tube 306 forward while compressing the spring S1 until the rotary cam 319 is positioned slightly ahead of the front edge of the cam wall 302 as shown in FIG. 17. At this time, the rotary cam 319 is slightly turned along the front inclined edge of the cam ring 320. When the push member 331 is released, the slidable tube 303 is retracted under the bias of the spring S2, and the cam ring 320 is also pushed back along the cam wall 302. The rotary cam 319 is also retracted along the cam wall 302 together with the seal tube 306 by being pushed by the legs 307 under the force of the spring S1, until the writing end 325 of the ink cartridge 322 projects through the hole 305 in the slidable tube 303 as shown in FIG. 18. The writing instrument is now ready for writing operation.

To bring the writing instrument from the writing condition back to the sealed condition, the push member 331 is pushed in the position shown in FIG. 18. When the push member 331 is pushed, the rotary cam 319 is advanced, and when the rotary cam 319 is positioned slightly ahead of the front edge of the cam wall 302 as shown in FIG. 17, the push member 331 is released. The rotary cam 319 is then slightly turned and then slightly pushed back by the legs 307 under the resilient force of the spring S1. The rotary cam 319 is then engaged by the front locking edge of the cam wall 302, thus preventing the seal tube 306 from being retracted. The slidable tube 303 is also retracted under the force of the spring S2 to thereby enable the front inner surface of the slidable tube 303 to push the sealing body 313 until the latter closes and seals the opening 310 in the seal tube 306. Therefore, the writing instrument is now in the sealed condition as shown in FIG. 15.

Figure 18A:
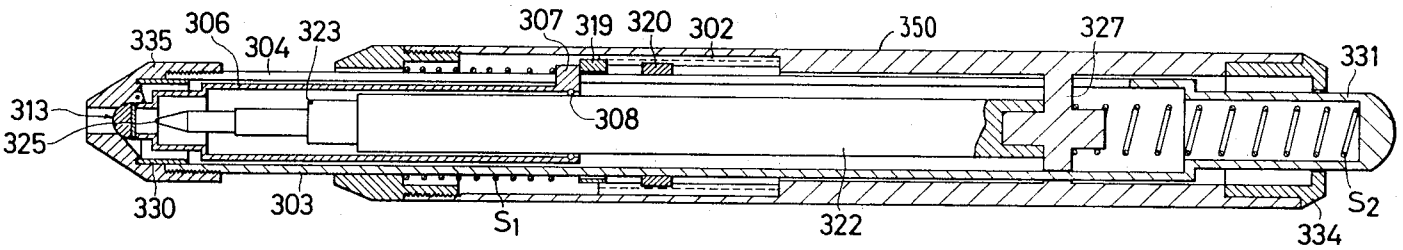
FIG. 18A shows a seventh embodiment.

Another embodiment of the invention will now be described with reference to FIG. 18A, in which the front barrel 301 and a rear barrel 332 of the previously described embodiment (FIGS. 15–18) are formed integrally with each other as a barrel 350 and further a connector 327 is formed integrally with a rear portion of 350 the barrel via its three legs. Three associated slits 304, 304, 304 are formed on the front side of a slidable tube 303. A push member 331 is formed integrally with the slidable tube 303. A ring 334 is fitted in a rear portion of the end opening of the rear barrel 350. After a reinforcement ring 330 is fitted in an interior of a tip member 335, the tip member 335 with the reinforcement ring 330 is threadedly engaged with a front end portion of the slidable tube 303. The reinforcement ring 330 serves to reinforce the front portion of the slidable tube 303 having the three slits 304, 304, 304. The other constructions are the same as those shown in FIGS. 15 to 18.

Figure 19:
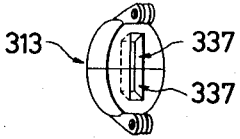
FIG. 19 shows an eighth embodiment.

Another embodiment of the invention will now be described with reference to FIG. 19 in which the seal member 313 is composed of openable divided halves each having on the rear side a straight groove 337. Such a seal member 313 is applicable to the foregoing embodiments.

Figure 20:
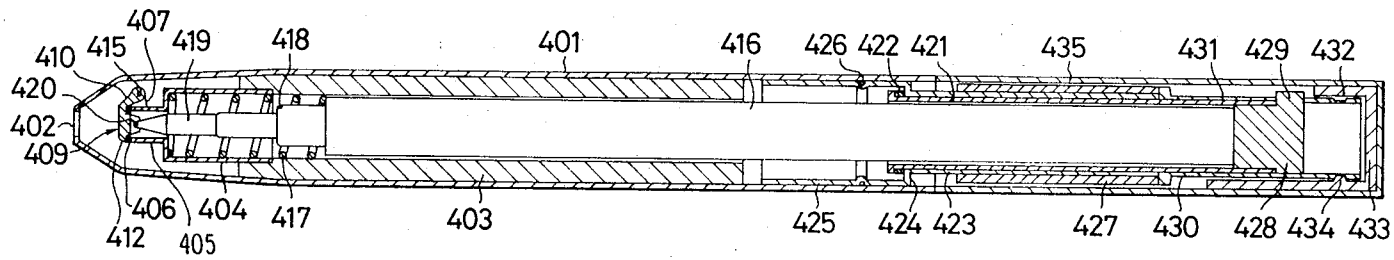

FIG. 20 is a cross-sectional view of a writing instrument according to another embodiment of the present invention. The writing instrument comprises a cylindrical front barrel 401 including a tapered distal end portion having a through hole 402 formed in a distal end thereof for passage therethrough of a writing tip of a writing member described before.

Figure 21:
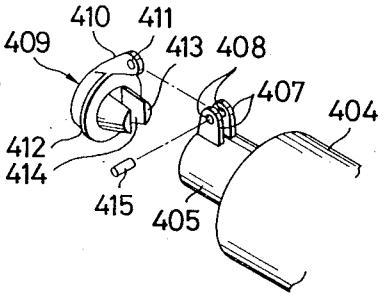
FIGS. 20, 21, 22 and 23 show a ninth embodiment of the invention.

A cylinder 403 is fixedly fitted in the front barrel 401 with an inner tube 404 attached to a front end of the cylinder 403. The inner tube 404 is made of a magnetic material. The inner tube 404 has a smaller-diameter front end portion 405 having an opening 406 in its distal end. As shown in FIG. 21, the smaller-diameter portion 405 has a pair of lugs 407, 407 having small apertures 408, 408, respectively.

A separate sealing body 409 is substantially disk-shaped and sized to close an opening 406 in the inner tube 404. The sealing body 409 has a leg 410 having a small aperture 411. A seal ring 412 is attached to a rear outer peripheral edge of the sealing body 409 and is of a size substantially equal to that of a front edge of smaller-diameter portion of the inner tube 404. The seal ring 412 is made of magnetic rubber. The sealing body 409 has on a rear surface thereof a projection 413 having a central recess 414.

For assembly, the lug 410 on the sealing body 409 is brought between the lugs 407, 407 on the inner tube 404, and a single pin 415 isembly, the lug 410 on the sealing body 409 is brought between the lugs 407, 407 on the inner tube 404, and a single pin 415 is inserted through the small apertures 408, 408 in the lugs 407, 407 and the small aperture 411 in the leg 410. the sealing body 409 is pivotably mounted on the front of the inner tube 404. When the sealing body 409 is angularly moved back, the seal ring 412 of magnetic rubber is attracted to the front edge of the inner tube 404 of magnetic material, and the sealing body 409 closes the opening 406 in the inner tube 404. When the sealing body 409 is turned forward, the opening 406 in the inner tube 404 is opened. Where there is no obstruction in the way, the sealing body 409 is attracted to the front end of the inner tube 404 under the magnetic force of the seal ring 412.

A spring 417 is disposed between an inner step of the inner tube 404 and a step on an outer periphery of a writing member 416 such as an ink cartridge in the vicinity of a distal end thereof, the ink cartridge 416 being fitted in the inner tube 404 and the cylinder 403. The ink cartridge 416 has a front air vent hole 418 and a smaller-diameter front end portion 419 with a writing tip 420 on its distal end. The air vent hole 418 may be formed in a tail end of the ink cartridge 416. The ink cartridge 416 has a rear end portion projecting backward beyond the rear end of the front barrel 401. A cylinder 421 is fitted over the projecting end portion of the ink cartridge 416. The cylinder 421 has a rear end portion extending slightly rearward of a rear end of the ink cartridge 416.

A seal ring 422 is fitted over the cylinder 421 behind a flange on a front end of the cylinder 421. Another cylinder 423 is fitted over the cylinder 421, the cylinder 423 being assembled onto the cylinder 421 from a rear end thereof. The cylinder 423 has a larger-diameter front end portion 425 with a step 424 at a rear end thereof. A resilient seal ring 426 is fitted over the larger-diameter portion 425. After the seal ring 426 is mounted, the larger-diameter portion 425 is mounted with a force fit in the front barrel 401 near a rear end thereof. Another cylinder 427 is fitted over a rear portion of the cylinder 423.

A slider 428 is mounted in a rear end of the cylinder 423 by being fitted from the rear end thereof, the slider 428 having a radially outward projection 429. A guide tube 430 is fitted over a rear end portion of the cylinder 421 and has a rear end projecting behind the rear end of the cylinder 421. The guide tube 430 has an axial slit 431 with the projection 429 of the slider 428 fitted therein. The projecting rear end of the guide tube 430 has a circumferential slot 432.

A cam tube 433 is fitted over the guide tube 430 and has an inner projection 434 fitted in the slot 432 in the guide tube 430. The cam tube 433 has a front inclined edge serving as a cam surface and including a locking edge which projects forwardly for a maximum interval.

A rear barrel 435 is fitted over the cam tube 433. The rear barrel 435 is brought over the cam tube 433 from a rear end thereof. The rear barrel 435 has a front end held against a rear end of the front barrel 401. The front barrel 401 is removably fitted over and rotatable with the larger-diameter portion 425 of the cylinder 423. The front and rear barrels 401, 435 constitute a body of the writing instrument.

FIG. 20 shows the writing instrument in a sealed condition. The tip end of the ink cartridge 416 is fully stored in the inner tube 404, and the seal ring 412 is magnetically attracted to the front edge of the inner tube 404, with the sealing body 409 closing and sealing the opening 406 in the inner tube 404. The ink cartridge 416 is retracted under the force of the spring 417, and the seal ring 422 on the front end of the cylinder 421 is held against the step 424 of the cylinder 423 to provide a seal between the cylinders 421, 423. The seal ring 426 fitted over the larger-diameter portion 425 of the cylinder 423 provides a seal between the front barrel 401 and the larger-diameter portion 425. The rear seals for the ink cartridge 416 are therefore effected by the seal rings 422, 426. As a consequence, the writing tip 420 and the air vent hole 418 are fully sealed. In this sealed condition, the projection 429 of the slider 428 is kept out of contact with a front edge of the cam tube 433.

Figure 23:
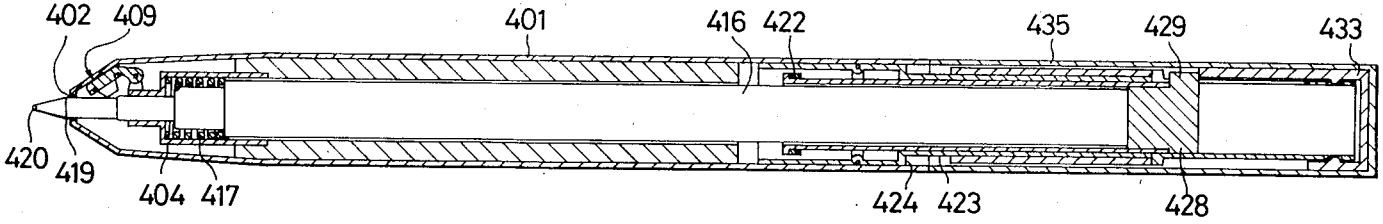

To bring the writing instrument from the sealed condition to a writing condition, the rear barrel 435 is turned with respect to the front barrel 401. When the rear barrel 435 is turned, the cam tube 433 turns therewith, with the projection 434 of the cam tube 433 fitted in the slot 432 in the guide tube 430. As the cam tube 433 turns, the cam surface or the front edge of the cam tube 433 is brought into contact with the projection 429 of the slider 428. Thereafter, the cam surface pushes the projection 429 to move forward the ink cartridge 416 while compressing the spring 417. The writing tip 420 of the ink cartridge 416 is fitted in the recess 414 in the sealing body 409 while at the same time a front inclined surface of the ink cartridge 416 abuts against shoulders of the recess 414. The writing tip 420 is therefore prevented from contacting the sealing body 409. The writing tip 420 is advanced while the front inclined surface of the ink cartridge 416 pushes aside the sealing body 409, until the smaller-diameter portion 419 of the ink cartridge 416 projects through the hole 402 in the front barrel 401 as shown in FIG. 23. The writing instrument is now in the writing condition. At this time, the projection 429 of the slider 428 is engaged by the locking edge of the cam tube 423. The writing instrument is in readiness for writing operation.

Figure 22:
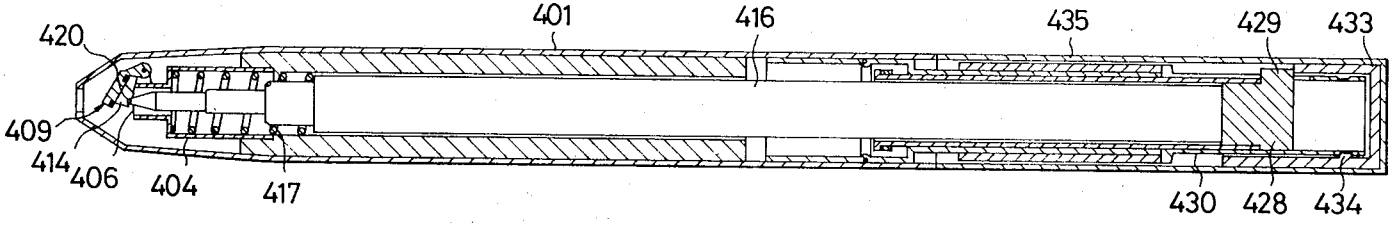

For bringing the writing instrument from the writing condition back to the sealed condition, the rear barrel 435 is turned in an opposite direction with respect to the front barrel 401. The projection 429 is unlocked from the locking edge of the cam tube 433, and thereafter moves back along the cam surface of the cam tube 433 since the ink cartridge 416 is urged backward under the force of the spring 417. The ink cartridge 416 also moves backward. When the seal ring 422 abuts against the step 424 of the cylinder 423, the ink cartridge 416 is prevented from being retracted. At this time, the tip end of the ink cartridge 416 is fully accommodated in the inner tube 406 and sealed as shown in FIG. 20 by the sealing body 409 which closes the opening 406 in the inner tube 404 under the magnetic attraction between the seal ring 412 and the inner tube 404. During movement from the position of FIG. 23 to the position of FIG. 20 through the position of FIG. 22, the ink cartridge 416 is retracted while the front inclined surface thereof is held against the shoulders of the recess 414 in the sealing body 409, so that the writing tip 420 is kept out of contact with the sealing body 409.

Figure 25:
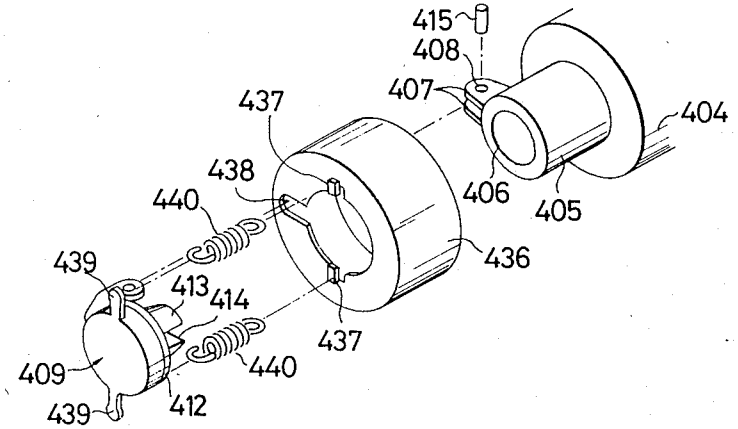
FIGS. 24 to 27 show a tenth embodiment.
Figure 27:
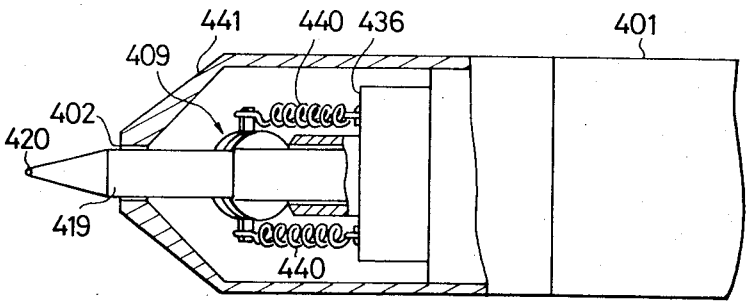
Figure 24:
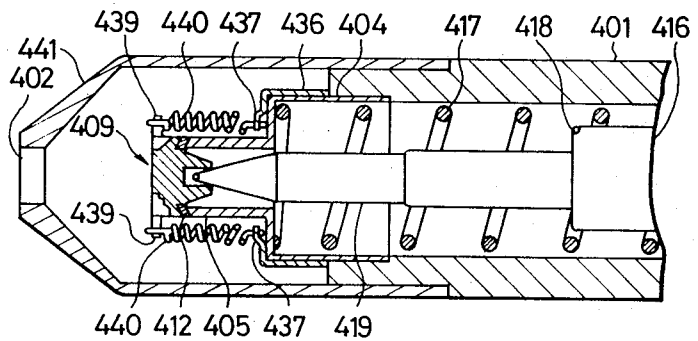
Figure 26:
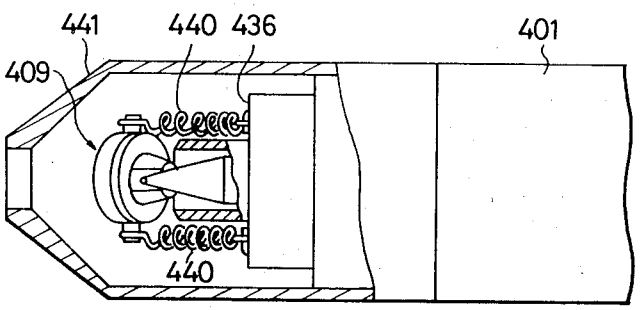

Another embodiment of the invention will now be described with reference to FIGS. 24 to 27, in which an inner tube 404 is mounted in the front barrel 401. As shown in FIG. 25, a mounting member 436 in the form of a cap has in its central portion a hole into which the smaller-diameter portion 405 of the inner cylinder 404 may be just fitted. A pair of diametrically opposite slots are formed in the mounting member 436 so that strips 437, 437 are formed extending from the slots. Also, another slot 438 is formed at a position between the slots 437 on the circumference of the hole. Lugs 407, 407 formed on the smaller-diameter portion 405 of the inner tube 404 are rendered to pass through the slot 438 and then the mounting member 436 is mounted on the larger-diameter portion of the inner tube 404. Thereafter, in the same manner as described above, the seal body 409 is mounted at the front portion of the smaller-diameter portion 405, but the front face end of the smaller-diameter portion is slightly tapered or slanted, and the seal ring 412 mounted on the seal body 409 has an associated slanted rear face to obtain a positive sealing effect. Instead of the magnetic effect, coil springs 440, 440 are laid between extensions 439, 439 formed on the seal body 409 and the strips 437, 437 of the mounting member 436 to urge the seal body 409 rearwardly, that is, in its closing direction. The tip member 441 is mounted on a front end of the front barrel 401. The tip member 441 constitutes a part of the barrel.

The operation of the embodiment shown in FIGS. 24 to 27 is apparent from the foregoing and explanations therefore have been omitted.

Figure 28:
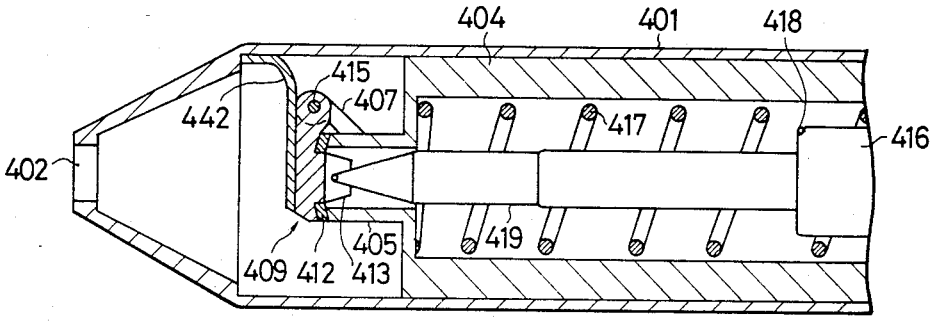
FIGS. 28 to 30 show an eleventh embodiment of the invention.
Figure 29:
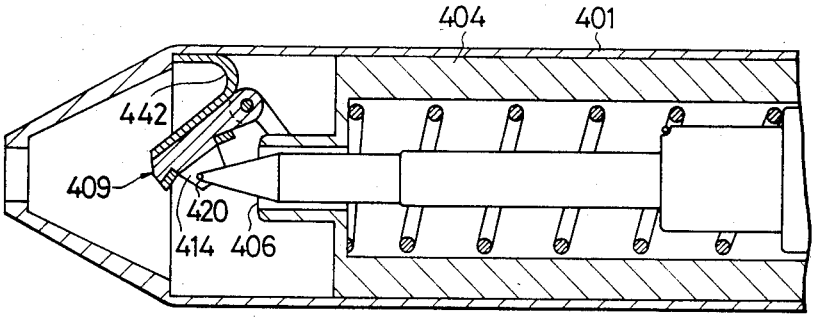
Figure 30:
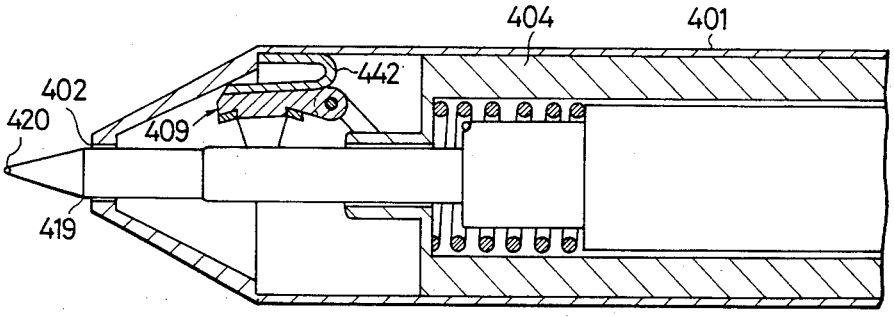

Another embodiment of the invention will be described with reference to FIGS. 28 to 30, in which a leaf spring 442 is mounted at one end to the inner surface of the front barrel 401 and at the other end to the front face of the seal body 409. It is possible to release the one end of the leaf spring 442 from the inner surface of the front barrel 401. The operation is apparent from FIGS. 28 to 30.

Figure 31:
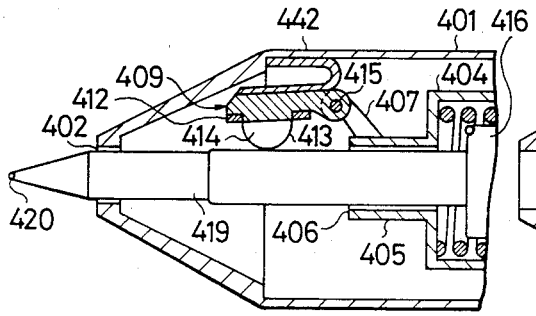
FIGS. 31, 32 and 33 show other embodiments of the invention.

Another embodiment of the invention will be described with reference to FIG. 31, in which a projection 413 of the seal body 409 is rounded to reduce a possible friction generated between the projection and the ink cartridge 414.

Figure 32:
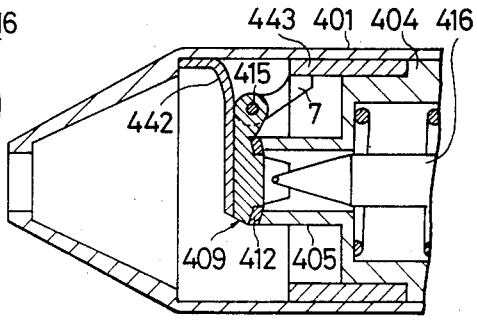

Another embodiment of the invention will be described with reference to FIG. 32, in which the seal body 409 is pivptally mounted on a ring member 443 fixedly mounted in the inner surface of the front barrel 401 in the front portion of the inner tube 404. The seal body 409 is urged to rotate backwardly by a leaf spring 442.

Figure 33:
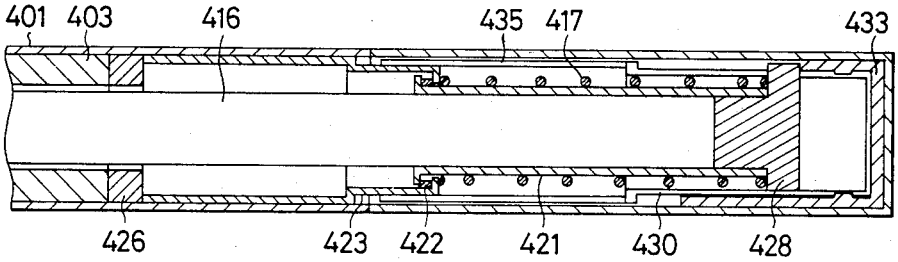

Another embodiment of the invention will be described with reference to FIG. 33, in which a spring 417 for biasing the ink cartridge 416 rearwardly is disposed on the rear side of the writing barrel. In this embodiment, a seal ring 426 is interposed between cylinders 403 and 423 fitted in the front barrel 401. The spring 417 is interposed between the rear end of the cylinder 423 and the slider 428 fitted in the rear end of the cylinder 421.

In this embodiment, it is necessary to firmly mount the ink cartridge 416 in the cylinder 421 to have a sufficient holding force against a friction caused by the seal body 409 when the ink cartridge 416 is moved from the forward position to the rearward position.

Figure 34:
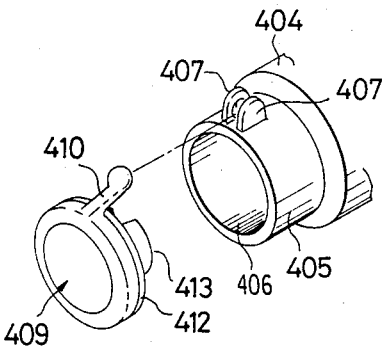
FIGS. 34 and 35 show still another embodiment of the invention.
Figure 35:
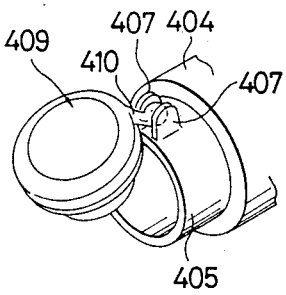

Another embodiment of the invention will be described with reference to FIGS. 34 and 35, in which an end portion of lug 410 extending from the seal body 409 is formed in a ball and an associated space in the form of a ball is formed between lugs 407, 407 extending from the inner tube 404. Then, the end portion of the lug 410 is pressingly inserted into the space defined between the the lugs 407, 407 of the inner tube 404.

What is claimed is:

1. A writing instrument comprising a body composed of a front barrel (401) and a rear barrel (435) which are relatively rotatable, a writing member (416) housed in said body and having a front writing tip (420), a transmission mechanism disposed between said body and said writing member (416) for moving said writing member (416) back and forth in response to relative rotation of said front and rear barrels (401), (435), an inner tube (404) mounted in said front barrel (401) and having an opening (406) defined in a distal end thereof, a sealing body (409) pivotally attached to said inner tube (404) and positioned adjacent to said opening (406) for opening and closing said opening (406), said sealing body having a protrusion formed on a rear side thereof, said protrusion having a groove formed therein for receiving said writing tip of said writing member, said protrusion guiding said sealing body so as to fit substantially precisely into said opening when said writing member is in a sealed position, said groove being smaller than a diameter of a tapered front end portion of said writing member just behind said writing tip, said groove being sufficiently deep to prevent said writing tip from contacting said sealing body when said writing member abuts against said protrusion, bias means for normally urging said sealing body (409) to close said opening (406), means for pushing aside said sealing body (409) to open said opening (406) against a force tending to close the latter while preventing said writing tip (420) from contacting said sealing body (409) when said writing member (416) advances, and seal means for providing a seal between said body and said writing member (416) at a position behind said sealing body (409).

2. A writing instrument comprising:

a body including a front barrel (401) and a rear barrel (435) which are rotatable relative to each other;

a writing member (416) housed in said body and having a front writing tip (420);

transmitting means for moving axially said writing member (416) in response to the relative rotation of said front and rear barrels (401, 435);

an inner tube (404) mounted in said front barrel (410) and having an opening (406) defined in a distal end thereof;

a sealing body (409) pivotally attached to said inner tube (404) for sealing said opening (406), said sealing body (409) having a protrusion formed on a rear side thereof and having a groove formed therein for receiving said front writing tip of said writing member, said protrusion guiding said sealing body so as to fit substantially precisely in said opening of said inner tube when said writing member is in a sealed condition, a width of said groove being smaller than a diameter of a tapered end portion of said writing member just behind said writing tip, said groove being sufficiently deep to prevent said front writing tip from contacting said sealing body when said writing member abuts against said protrusion;

bias means for normally urging said sealing body (409) to close said opening (406);

means for pushing aside said sealing body (409) to open said opening (406) against the force tending to close said opening (406) while preventing said writing tip (420) from contacting said seal body (409) when said writing member (416) advances; and rear sealing means for providing a seal between said body and said writing member (416) at a position behind said sealing body (409).

3. The writing instrument according to claim 2, said bias means including magnetic members.

4. The writing instrument according to claim 2, said bias means including coil springs (440).

5. The writing instrument according to claim 2, said bias means including a leaf spring (442).

6. The writing instrument according to claim 2, said sealing body (409) being removably attached to said distal end of said inner tube (404).

7. A writing instrument as claimed in claim 2, wherein said opening (406) is circular.

8. A writing instrument comprising a barrel having a front opening (203), a writing member (217) having a writing tip (220) on a front end thereof and disposed in said barrel for back-and-forth movement therein, a mechanism disposed between said barrel and said writing member (217) for locking said writing member (217) in an advance position and returning said writing member (217) in a retracted position, a sealing body (206) pivotable about a single point in the vicinity of said opening (203) for opening and closing said opening (203) thereby sealing said writing tip (220), said sealing body (206) having a protrusion (211) having a groove (212) formed therein, said writing tip (220) of said writing member fitting into said groove when said writing member is in said retracted position, whereby said protrusion (211) abuts said writing member (217) on either side of said writing tip (220), said protrusion (211) guiding said sealing body (206) so as to fit substantially precisely into said opening (203) when said writing member is in said retracted position, a width of said groove (212) being smaller than a diameter of a tapered front end portion of said writing member just behind said writing tip, said groove being sufficiently deep to prevent said writing tip from contacting said sealing body (206) when said writing member abuts against said protrusion (211), whereby said writing tip is prevented from contacting said sealing body (206), bias means disposed between said sealing body (206) and said barrel for normally urging said sealing body (206) to seal said writing tip, means for pushing aside said sealing body (206) to open said writing tip against a force tending to seal the latter while preventing said writing tip (220) from contacting said sealing body (206) when said writing member (217) advances, and seal means for providing a seal between said barrel and said writing member (217) at a position behind said sealing body (206).

9. A writing instrument comprising:

an axial barrel having a front opening (216) and a cylindrical front barrel (201);

a writing member (217) having a writing tip (220) at a front tapered end thereof, said writing member (217) being housed in said axial barrel;

actuating push-rod means for axially moving said writing member in said axial barrel;

spring means ($S_1$) for normally urging said writing member rearwardly;

means for retaining said writing member (217) in an advanced position where said writing tip is projected from said opening (216) of said axial barrel and in a retracted position where said writing member is fully housed in said axial barrel;

front sealing means for sealing said writing tip (220) of said writing member (217) in said retracted position, said front sealing means being provided at a front end of said cylindrical front barrel (201) and including a sealing body (206) and a sealing member (210) for a sealing an opening (203) of said cylindrical front barrel (201), said sealing body (206) comprising a single member pivotable at one side of said opening (203), said sealing body (206) having at least a protrusion (211) on a rear side thereof extending toward said writing member (217) and having a groove (212) formed therein for receiving said writing tip (220) of said writing member (217), said protrusion (211) abutting said writing member (217) on either side of said writing tip (220), a width of said groove (212) being smaller than a diameter of said tapered end of said writing member (217) behind said writing tip (220), said writing tip (220) fitting into said groove (212) when said writing tip (220) is sealed, said protrusion (211) guiding said sealing body (206) so as to fit substantially precisely into said opening (203) of said cylindrical front barrel (201), said groove (212) being sufficiently deep to prevent said writing tip (220) from contacting said sealing body (206);

biasing means for biasing said front sealing means to seal said writing tip;

means for pushing aside said front sealing means when said writing member (217) advances, said writing tip (220) sliding within said groove and avoiding contact with said sealing body (206) during advancement of said writing member (217); and rear sealing means for sealing said writing tip at a position behind said front sealing means at least in said retracted position.

10. The writing instrument according to claim 9, said axial barrel further having a front conical member (215), said cylindrical front barrel (201) being coupled to said front conical member (215) and to a rear barrel (221).

11. The writing instrument according to claim 10, said sealing body (206) being biased to seal said opening (203) of said cylindrical front barrel (201) by said biasing means.

12. The writing instrument according to claim 10, said spring means ($S_1$) being provided in said front barrel.

13. The writing instrument according to claim 10, said spring means ($S_1$) being provided in said rear barrel.

14. The writing instrument according to claim 10, said actuating push-rod means including a push rod (225) extending outwardly from said rear barrel.

15. The writing instrument according to claim 10, said front conical member (215) being integral with said front barrel (201).

16. The writing instrument according to claim 9, said means for pushing aside said front sealing means including a recess (212) for receiving said writing tip (220).

17. A writing instrument as claimed in claim 9, wherein said opening (203) is circular.

18. A writing instrument comprising a barrel, a writing member (322) housed in said barrel and having a writing tip (325) on a distal end thereof, said writing member (322) being coupled to said barrel, a seal tube (306) provided over said writing member (322) for back-and-forth movement thereof and having an opening (310) in a distal end thereof for passage therethrough of said writing tip (325) of said writing member (322), a slidable tube (303) provided over said seal tube (306) movable relative to said seal tube (306), a sealing body (313) pivotable about a single point in the vicinity of said opening (310) for opening and closing said opening (310), said sealing body having a protrusion formed on a rear side thereof, said protrusion having a groove formed therein for receiving said writing tip of said writing member, said protrusion guiding said sealing body so as to fit substantially precisely into said opening (310) when said writing member is in a sealed position, said groove being smaller than a diameter of a tapered front end portion of said writing member just behind said writing tip, said groove being sufficiently deep to prevent said writing tip from contacting said sealing body when said writing member abuts against said protrusion, movement of said sealing body (313) being controlled according to relative positioning of said seal tube (306) and said slidable tube (303) and seal means for providing a seal between said seal tube (306) and said writing member (322) at a position behind said sealing body (313).

19. A writing instrument comprising:

a barrel;

a writing member (322) having a writing tip (325), said writing member being disposed in said barrel and being coupled to said barrel;

a seal tube (306) provided over said writing member (322), said seal tube (306) being axially movable and having in a front end thereof an opening (310) through which said writing tip is projectable;

a slidable tube (303) provided over said seal tube (306), said slidable tube (303) being axially movable and spring-biased rearwardly;

actuating push means for axially moving said seal tube (306) between an advanced seal position and a retracted release position;

means for retaining said seal tube (306) at said advanced seal position and said retracted release position;

front sealing means for closing said opening (310) of said seal tube (306) and including a seal body pivotable at said opening (310) of said seal tube (306), said sealing body being provided with a protrusion on a rear side thereof, said protrusion having a groove for receiving said writing tip of said writing member, said protrusion guiding said sealing body so as to fit substantially precisely in said opening (310) of said seal tube (306) when said writing member is in said retracted release position, said groove being sufficiently deep to prevent said writing tip from contacting said sealing body when said writing member abuts against said protrusion, a width of said groove being smaller than a diameter of a tapered end portion of said writing member just behind said writing tip, movement of said front sealing means controlled according to the relative positions of said slidable tube (303) and said seal tube (306); and rear sealing means (308) provided between said seal tube (306) and said writing member (332).

20. A writing instrument as claimed in claim 19, wherein said opening (310) is circular.

* * * * *